US008797125B2

(12) United States Patent
Haunberger et al.

(10) Patent No.: US 8,797,125 B2
(45) Date of Patent: Aug. 5, 2014

(54) FILTER ARRANGEMENT

(75) Inventors: Thomas Haunberger, Bad Reichenhall (DE); Manfred Stolle, Bad Aibling (DE)

(73) Assignee: Kathrein-Werke KG, Rosenheim (DE)

( * ) Notice: Subject to any disclaimer, the term of this patent is extended or adjusted under 35 U.S.C. 154(b) by 235 days.

(21) Appl. No.: 12/771,462

(22) Filed: Apr. 30, 2010

(65) Prior Publication Data

US 2010/0277260 A1 Nov. 4, 2010

(30) Foreign Application Priority Data

Apr. 30, 2009 (DE) ..... 10 2009 019 547

(51) Int. Cl.
*H01P 1/202* (2006.01)
*H01P 7/04* (2006.01)

(52) U.S. Cl.
CPC .. *H01P 1/202* (2013.01); *H01P 7/04* (2013.01)
USPC ..... 333/206; 333/222

(58) Field of Classification Search
CPC ..... H01P 1/202; H01P 7/04
USPC ..... 333/12, 206, 222, 207, 245
See application file for complete search history.

(56) References Cited

U.S. PATENT DOCUMENTS

| | | | | |
|---|---|---|---|---|
| 2,392,664 | A | 1/1946 | Gurewitsch | |
| 2,465,801 | A | 3/1949 | Gurewitsch | |
| 2,751,558 | A | 6/1956 | Grieg et al. | |
| 3,343,069 | A | 9/1967 | Tsuda | |
| 3,537,042 | A | 10/1970 | Simmen | |
| 3,872,412 | A | 3/1975 | Seidel | |
| 4,004,257 | A | 1/1977 | Geissler | |
| 4,999,596 | A * | 3/1991 | Nakatani et al. | 333/204 |
| 5,291,161 | A * | 3/1994 | Saka | 333/204 |
| 6,255,920 | B1 * | 7/2001 | Ohwada et al. | 333/206 |
| 6,278,341 | B1 | 8/2001 | Lindqvist | |
| 6,614,329 | B1 * | 9/2003 | Woods et al. | 333/204 |
| 7,372,373 | B2 * | 5/2008 | Borisov et al. | 340/870.02 |

FOREIGN PATENT DOCUMENTS

EP 1160910 A1 12/2001

OTHER PUBLICATIONS

"Microstrip Filters for RF/Microwave Applications", Wiley Series in Microwave and Optical Engineering by John Wiley & Sons, Inc., 2001, Jia-Sheng hong and M.J. Lancaster, Chapter 5, Seiten, pp. 109-121.

"Microstrip Filters for RF/Microwave Applications", Wiley Series in Microwave and Optical Engineering, by John Wiley & Sons, Inc., 2001, Jia-Sheng Hong and M.J. Lancaster, Chapter 6, Seiten, pp. 161-190.

Mottonen et al, "Subharmonic Waveguide Mixer at 215 GHz Utilizing Quasivertical Schottky Diodes," Microwave and Optical Technology Letters, vol. 27, No. 2, pp. 93-97 (Oct. 20, 2000).

* cited by examiner

*Primary Examiner* — Benny Lee
*Assistant Examiner* — Gerald Stevens
(74) *Attorney, Agent, or Firm* — Nixon & Vanderhye P.C.

(57) ABSTRACT

An improved filter arrangement includes an HF inner conductor, an outer conductor arrangement inside which the HF inner conductor is arranged, and at least one stub line which branches off from the HF inner conductor at a connection point. The HF inner conductor and the at least one additionally provided stub line are arranged in a common outer conductor arrangement.

23 Claims, 8 Drawing Sheets

FILTER ARRANGEMENT

BACKGROUND

Filter arrangements and, in turn, stop filters are of great significance in many areas of electrical engineering and particularly also in communication engineering and mobile telecommunications. Trap circuits of this type can be realised, as is known, for example by a parallel circuit of a coil and a capacitor in the form of an oscillating circuit. The filter arrangements concerned can consist, for example of a high-pass (HP), a low-pass (LP) or a band-pass (BP) which are constructed, for example from series and/or parallel circuits of L/C components.

Such filter arrangements or trap circuit filters are often used in mobile telecommunications for operating multi-band antennae in order to achieve, for example a decoupling of approximately 50 dB between the frequency bands. Thus, filters of this type can also be used, for example for intersystem decoupling in multi-band antennae, because additional stop filters are required here to achieve the aforementioned 50 dB decoupling between the frequency bands. Furthermore, a good adaptation (VSWR) and a low attenuation have to be ensured in the transmission band of the frequency band to be transmitted.

Finally, solutions are also known in which a transformation line and associated stub lines are configured as microstrip lines on a printed circuit board. Solutions of this type can be inferred as being known, for example from the prior publication "Microstrip Filters for RF/Microwave Applications", Wiley Series in Microwave and Optical Engineering, by John Wiley & Sons, Inc., 2001, Jia-Sheng Hong and M. J. Lancaster, Chapter 6, pages 161-190 and from Chapter 5 "Low-pass and Bandpass Filters" from the same prior publication, namely pages 109 to 121.

A corresponding HF filter arrangement is also to be taken as known from U.S. Pat. No. 6,278,341 B1, for example. The filter is constructed in such a way that one or more stub lines lead out from an HF inner conductor. The inner conductor is arranged at a distance from the outer conductor. The stub lines leading out from the inner conductor are arranged directly adjacent to an outer conductor portion. In other words, the stub line is arranged on one side of a substrate, the substrate being positioned on a corresponding outer conductor surface in such a way that the stub line cooperates directly with the outer conductor.

In this respect, it is also known to construct trap circuit filters, instead of the above-mentioned microstrip stub lines which cooperate directly with an individual outer conductor, using coaxial cables. In this case, one or more stub lines are branched off from a signalling line transmitting an HF signal. For this purpose, arranged on the HF signalling line are, for example triple solder connectors, one of these soldered joints serving as the branching point for the mentioned stub line which terminates open, i.e. in open circuit. In this respect, a plurality of such stub lines can be arranged offset in the longitudinal direction of the HF signalling line and they also run towards one another, for example between two triple solder connectors and terminate freely in each case. It is then also possible to provide transformation paths.

Filters of this type using coaxial cables (also for the stub lines) are very tolerance-sensitive and cannot be optimally adjusted due to their method of construction (using the separate cable impedances and the solder connectors).

SUMMARY

The object of the invention is to provide an improved filter compared to the prior art, in particular a simpler filter which can thus be produced more economically.

It must be stated as being extremely surprising that, in the context of the invention, a stop filter, i.e. a trap circuit filter is provided which is of a very simple construction, can be produced very simply and has the desired electrical characteristics. The filter according to the invention also has advantages in this respect, i.e. adaptations to the stop frequency etc. can be easily carried out.

The trap circuit filter according to the invention is characterised in that similarly to the construction of a coaxial trap circuit filter of the prior art, stub lines are used which branch off from the HF signal-transmitting main line, although these stop lines do not have their own outer conductor, i.e. are not constructed as separate coaxial lines or microstrip lines, but the HF main signalling line and the stub lines branching off therefrom are arranged in a common outer conductor, i.e. in a common outer conductor arrangement.

A favourable and space-saving arrangement of the filter according to the invention can be realised in that the stub lines which have only one inner conductor structure are arranged in their basic longitudinal extent more or less parallel to the main HF line which transmits the signal and are only connected to the main line electrogalvanically by a short angle piece. The entire arrangement can then be accommodated in an outer conductor pipe of any outer conductor cross-sectional shape, i.e. in a cylindrical outer conductor, in an outer conductor with an angular cross section etc. There are no restrictions in this respect.

The impedance of the stop filter can easily be adjusted in a continuously variable manner. The impedance can be easily changed by changing the distance of the stub line, realised merely in the form of an inner conductor, to the outer conductor which jointly surrounds this stub line and the HF main line. The shorter this distance, the lower/smaller the impedance (low impedance). The stub line is preferably configured in the form of a planar material, i.e. in the form of a metal strip. The wider this strip becomes (more or less in parallel orientation to the outer conductor pipe surrounding it), the lower/smaller the impedance thus also becomes (lower impedance). Thus the impedance can be increased or decreased by changing the aforementioned distance between stub line and common outer conductor on the one hand or by increasing the width of the stub line.

The stub lines can also be realised in multi-stage form, i.e. with different impedances. In other words, the stub lines can merge from a relatively wide portion into a narrower portion compared thereto, such that its width varies. Consequently, it is possible to realise very large transmission bands. The stop band is adjusted with the number of stub lines (poles). Likewise, not only can the stub lines be strengthened in two or more stages with the formation of different widths, but they can also have different diameters (material thicknesses).

In this respect, the width of the stub line preferably increases towards its open end.

If the band width which is to be blocked is to be increased, the number of stub lines must optionally be increased. In other words, the number of poles must be increased accordingly as a function of the band width which is to be blocked. In this respect, a plurality of stub lines can be arranged offset relative to one another in the longitudinal direction of the HF signalling line, in which case the stub lines can run towards one another for example, and are optionally arranged offset relative to one another in the peripheral direction of the signalling main line. Consequently, it is thus possible to realise a plurality of stub lines in a very space-saving manner. It is even possible, starting from a common branching point, for a plurality of stub lines to be arranged via angle pieces which are offset with respect to the signalling main line in the peripheral direction and which effectively have no mutual influence on one another.

The solution according to the invention also has major advantages most notably insofar as particularly high HF outputs can be transmitted. In the context of the invention, very thick inner conductors can be used for the signalling main line, which also results in particularly low resistance values in direct-current transfer. In contrast, the prior art solution frequently only allowed the use of comparatively thin inner conductors.

A mechanical improvement and increase in stability can also be realised, if required, in that positioned, for example on the signalling main line (i.e. the transformation line) are electrical spacers, for example in the form of dielectric discs, on the outer periphery of which the stub lines then rest which run parallel to the signalling main line. If required, dielectric spacers can also be positioned on the stub lines such that they, when assembled with the outer conductor, cannot contact the outer conductor itself and/or as a result of this, also keep the distance from the signalling main line or transformation line.

Finally, the use of a dielectric of this type also results in a shortening factor for the stub lines. Therefore, to summarise, the following advantages can be realised in the context of the invention:

- in the context of the invention, a particularly simple construction method can be realised in that one or more stub lines are arranged in a common outer conductor;
- in the case of a plurality of stub lines, these can be nested one inside another, i.e. arranged mutually offset with respect to the signalling main line in the peripheral direction, thereby requiring only a very small amount of space (consequently the overall length of the stop filter can also be minimised);
- the stub lines can be arranged offset relative to one another in the peripheral direction such that, for example, two stub lines can be introduced in the same portion of the outer conductor;
- the trap circuit filter arrangement according to the invention can be directly installed in an HF connector (more specifically can be integrated therein);
- the stub lines can be, but do not have to be decoupled from one another by separate outer conductors or their own outer conductors;
- the stop filters according to the invention allow a high stop-band attenuation, in particular for mobile communications bands (30 dB). Furthermore, it is also possible to realise a very good VSWR ratio (from, for example >30 dB in the transmission band), thus a very favourable voltage standing wave ratio;
- the coaxial construction of the filter makes it hardly sensitive to radiation;
- no radiation to the outside, since the stub lines are arranged inside the coaxial outer conductor which is closed to the outside;
- the dimensions of the filter can also be reduced by filling the empty space inside the outer conductor with a suitable dielectric;
- overall, this allows a very compact configuration;
- the filter can be produced from an injection moulding for example, so that production is possible with the lowest manufacturing tolerances;
- the inner conductor stub lines can be configured as a stampings/bent parts, and can consist of round material or flat material, etc;
- the configurations of the outer conductors can differ, i.e. in cross section they can be circular, square, U-shaped or rectangular;
- by a suitable configuration and change in position of the stub lines (for example the formation of final capacities), various characteristic impedances and very large band widths can be realised;
- the stub lines can be constructed in many stages, in other words they can have over their length different portions with varying widths, the width preferably increasing towards their open end; consequently, a particularly good wide band can be realised;
- since series capacitors are not required, the filter according to the invention is particularly also suitable for the transmission of direct current signals and data signals, for example modem signals.

BRIEF DESCRIPTION OF THE DRAWINGS

In the following, further advantages, details and features of the invention will emerge from the embodiments illustrated in drawings, in which.

DETAILED DESCRIPTION OF NON-LIMITING EMBODIMENTS

Figure 1:
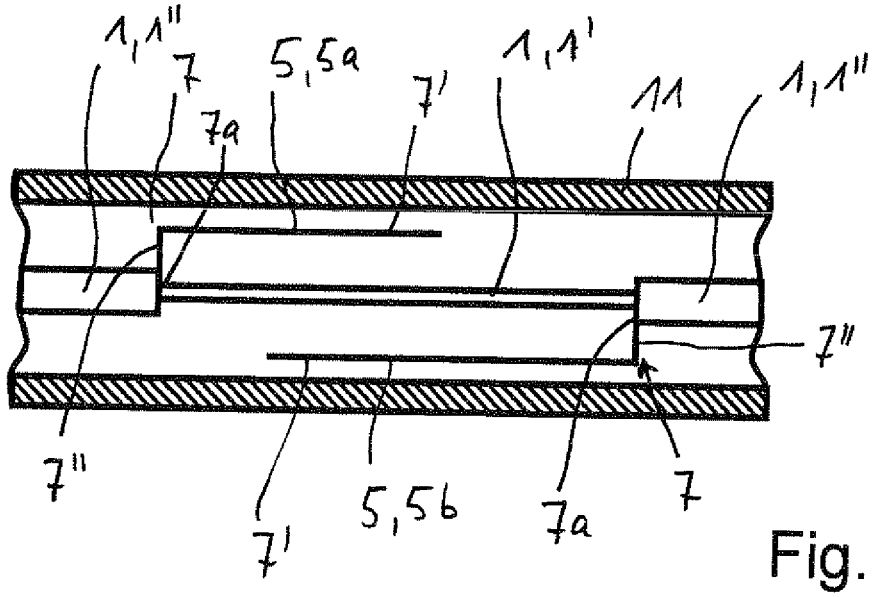
FIG. 1 is a schematic axial sectional view of a first embodiment according to the invention.

FIG. 1 shows an HF inner conductor 1 which can consist, for example of a metallic, rod-shaped inner conductor.

The HF inner conductor 1 forms a high-impedance transformation line 1' which, in the illustrated embodiment, extends between two inner conductor portions 1" which are offset with respect to one another in the longitudinal direction of the HF inner conductor 1. It can be seen from the drawing that the high-impedance transformation line portion 1' is provided with a relatively thin line cross section compared to the adjoining inner conductor portion 1", which is a 50Ω system.

In the illustrated embodiment, although not absolutely necessary, emanating at the transitions, directed towards one another, from the inner conductor portion 1" to the transformation line 1', a respective stub line 5, in the illustrated embodiment a stub line 5*a* and 5*b* is connected electrogalvanically and extends over its greatest length more or less parallel to the HF inner conductor 1 and is connected mechanically and electrically to the HF inner conductor 1 by a connecting angle 7.

In the illustrated embodiment, the length of the two stub lines 5*a* and 5*b* is selected to be different, thereby increasing the number of mutually offset stop poles, as a result of which the band width which is to be blocked, is increased.

The length of the respective stub line is selected such that as a function of the desired stop effect, the open-circuit operation is transformed into a short circuit at the respective connection point 7*a* at which the stub line 5 is electrically connected to the HF inner conductor 1.

The electrical length of the transformation line 1' is selected such that the frequency response caused by the at least one stub line or the frequency responses caused by the plurality of stub lines (for example 5*a*, 5*b* etc.) are compensated or overcompensated. In a over-compensated frequency response, the "next" stub line produces a compensation.

Thus, for example a first stub line would cause a frequency response which would be over-compensated by the adjoining transformation line. The adjoining second stub line then compensates the "over-compensated" frequency response caused by the transformation line. Consequently, it is possible to achieve an optimum adaptation of the filter.

The lengths of the transformation lines and the impedance of the transformation line are thereby selected for an optimum frequency compensation. As a result, a particularly good VWSR ratio can also be realised overall.

The characteristic in the context of the invention is that not only the HF signalling line 1, i.e. the transformation line 1', but also the one or more stub lines 5 or 5*a*, 5*b* etc. are accommodated in a common outer conductor arrangement 11. In other words, the stub lines do not have any further outer conductor arrangements 11 associated separately therewith. In this respect, the tubular outer conductor arrangement shown in axial section in FIG. 1, like the inner conductor 1" is also separated from the inner conductor by an insulator or by a dielectric which, however, is not shown in more detail in FIG. 1.

Figure 2:
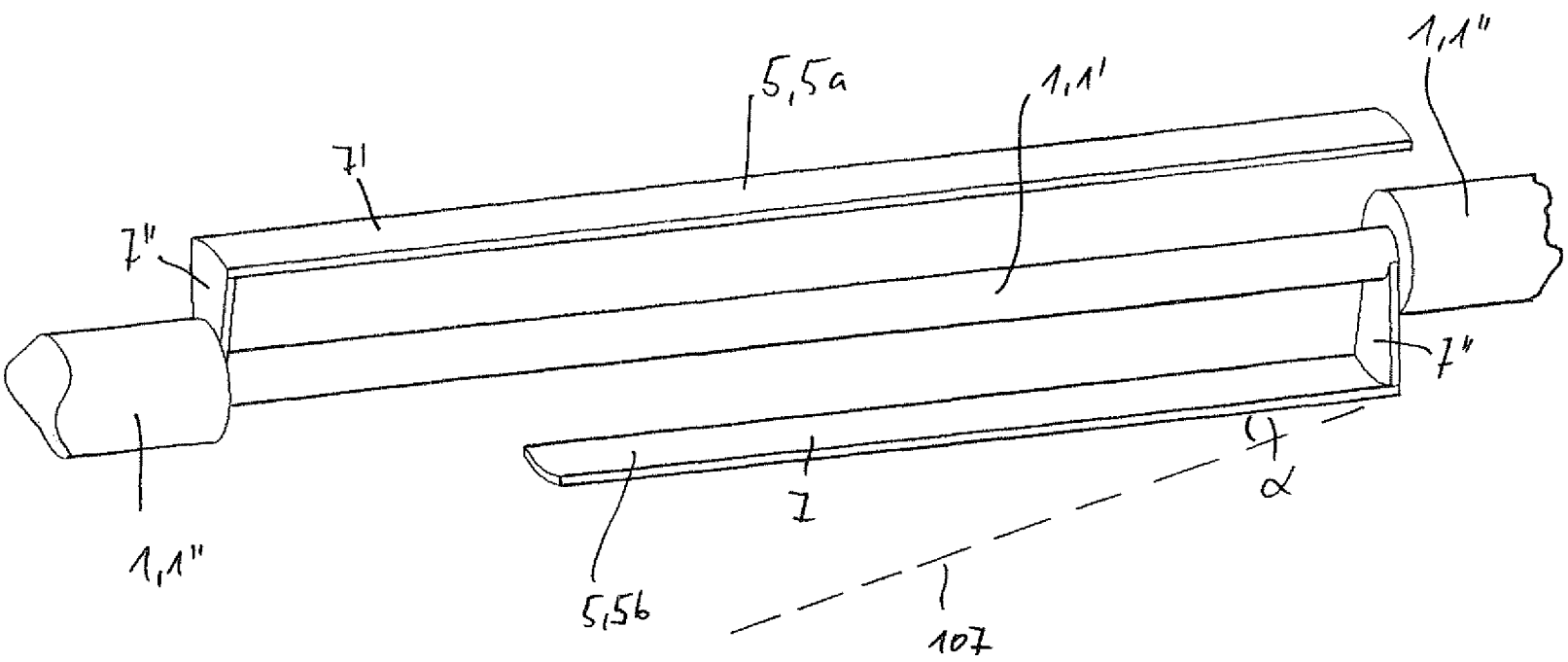
FIG. 2 is a spatial view of the embodiment according to FIG. 1, omitting the outer conductor.
Figure 3A:
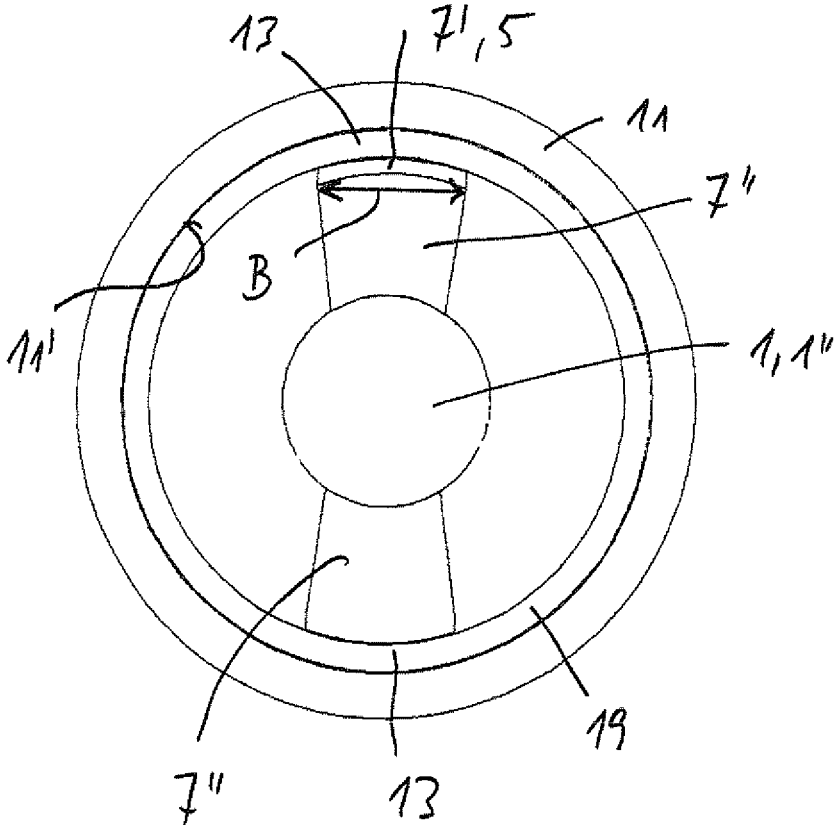
FIG. 3*a* is an axial sectional view through the embodiment according to FIGS. 1 and 2.
Figure 3B:
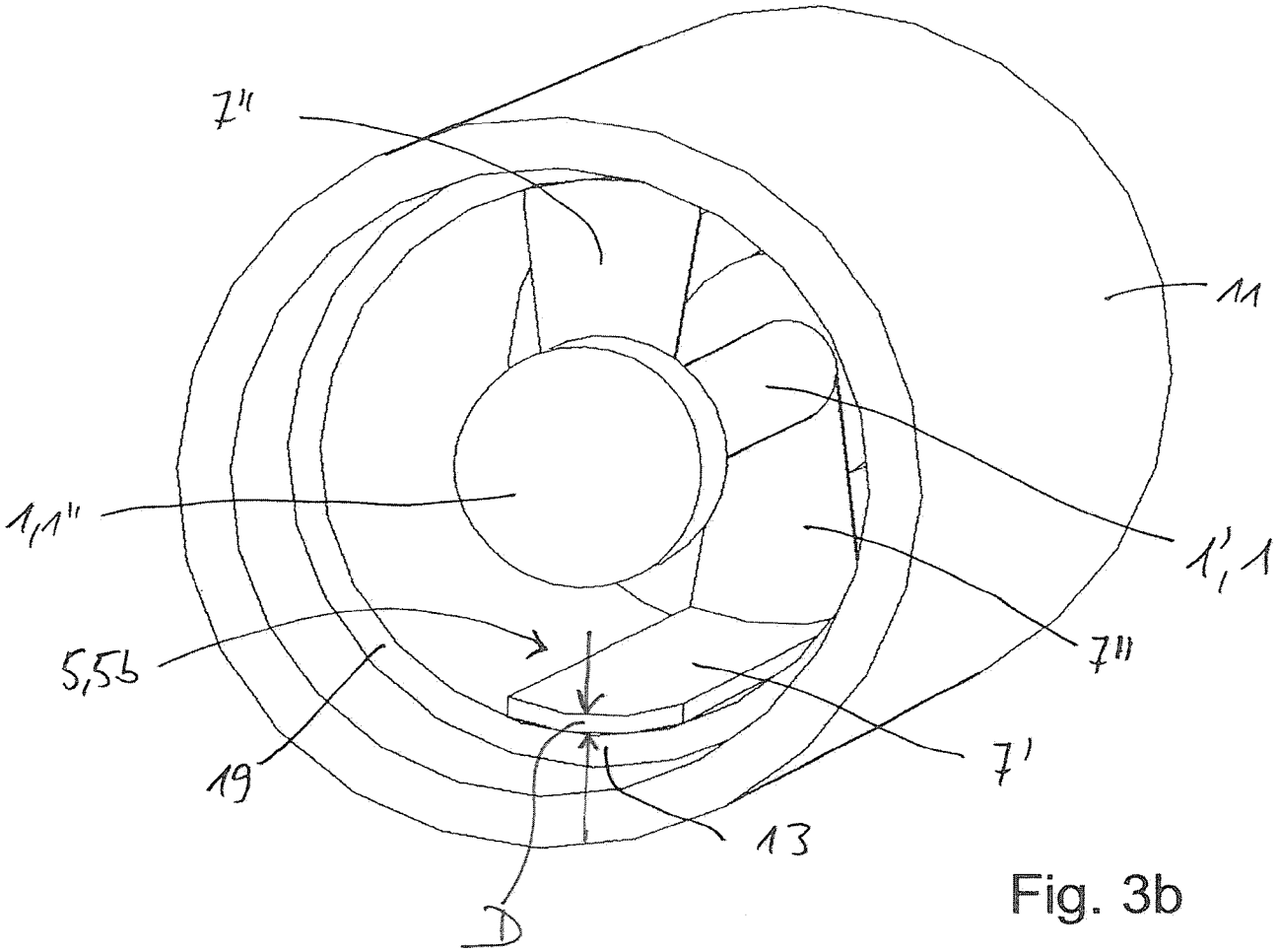
FIG. 3*b* is a spatial view of a detail with respect to the embodiment according to FIGS. 1 to 3.

As emerges from the spatial view according to FIG. 2 and in particular also from the axial cross-sectional view according to FIG. 3*a* or the spatial view of a detail according to FIG. 3*b*, the stub lines 5 are not formed from round material (although this is possible), but preferably from a flat material, similarly to an electrically conductive metal strip. The metal strip of the stub line 5 extends with its leg 7' in a length of preferably more than 60%, in particular more than 70%, 80% or more than 90% more or less parallel to the HF signal-transmitting inner conductor arrangement 1 and is connected to the HF inner conductor 1 only by a short leg 7" which runs radially to the inner conductor 1 and is anchored and held by mechanical means.

Figure 1A:
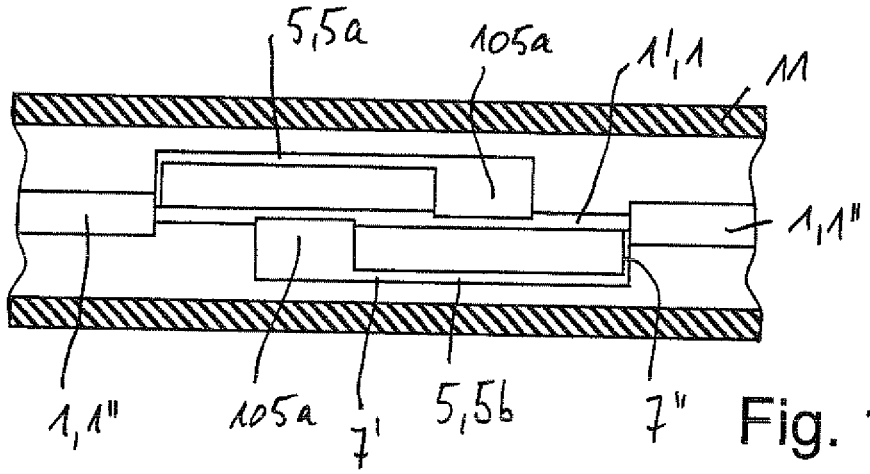
FIG. 1*a* shows an embodiment, modified compared to FIG. 1, with strip line portions in semi-cylindrical or part cylindrical form.
Figure 1B:
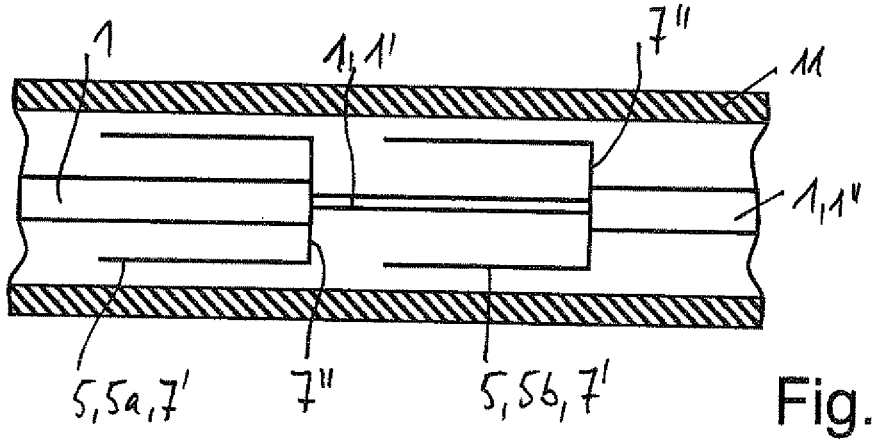
FIG. 1*b* shows a further modified embodiment with tubular stub lines receiving the inner conductor or transformation conductor coaxially.

As already mentioned, the stub lines 5, i.e. in particular the legs 7' can also be formed from round material, for example also with an almost semi-circular cross section. This would afford the possibility of being able to arrange at least two stub lines, running in the same direction or in opposite directions, such that they run in the centre with the transformation line 1' in a same portion of the transformation line 1'. The legs 7' configured to curve coaxially outwards would then come to rest preferably coaxially to the outer conductor or outer conductor pipe. In this respect, reference is made to FIG. 1*b* in which, unlike FIG. 1, a leg 7' starting from the connection point 7*a* or the radial leg 7", running lengthwise to the transformation conductor 1' in the illustrated embodiment, of the stub line 5 comprises adjacent to the free end a stub line portion 105*a* which has a significantly greater width. This stub line portion 105*a* with its greater width B is configured to be semi-cylindrical, more specifically coaxially to the inner conductor or transformation conductor 1, 1'. The further stub line which runs in the opposite direction thereto and is located positioned below in FIG. 1*a* is configured in the same way such that both stub lines overlap without the semi-circular strip line portions 105*a* being able to contact one another. In this configuration, the strip line portions 105*a* could also be configured to be less than semi-circular in cross section or could even be provided with a partially circular strip line portion including more than 180°.

All the stub lines or at least the freely terminating leg 7' can likewise be cylindrical and can be arranged with a lateral offset to the transformation line 1 inside the outer conductor. Finally, the stub lines can be cylindrical and can be arranged coaxially to the transformation line, such that in other words, the transformation line 1 penetrates the cylindrical stub line coaxially. If, for example, two provided stub lines 5 have a different diameter with a cylindrical shape, it is possible to provide two or more coaxial stub lines even in the same portion of the path based on the transformation line 1', which stub lines are preferably all arranged coaxially with respect to one another with the transformation line in the centre. This variant is represented in axial section, for example with reference to the modification according to FIG. 1*b*, where the radial leg portions 7" of the two stub lines are effectively configured as the base of a cylindrical pot. In this case, the two stub lines are directed with their open sides in the same direction and are positioned offset with respect to one another such that one stub line coaxially receives the inner conductor 1 and the other stub line coaxially receives the transformation line 1' configured with a smaller radius compared thereto. Both cylindrical bases 7" are electrically connected to the inner conductor at the graduated transition from the inner conductor 1 to the transformation conductor 1'.

In principle, it would also be possible for the leg 7' which runs parallel to the inner conductor 1 in the drawings to also be arranged at an angle to the axial extent of the HF inner conductor 1, more specifically such that this leg 7' is arranged to run at an angle α to the axial extent of the inner conductor 1. This is indicated merely in dashed lines in FIG. 2 for a leg 107. In other words, it is thus possible for the stub line 5 and in particular the freely terminating legs 7' to have different spacings to the outer conductor 11 or to the inner conductor arrangement 1 over the length of the stub lines. In this respect, the arrangement does not have to be oriented running at a continuous angle α to the axial extent of the inner conductor 1, but stepped divisions or portions can also be provided in which portions of the leg 7' of the respective stub line 5 have different spacings to the inner conductor or to the outer conductor.

The axial sectional view according to FIG. 3*a* also shows a common tubular outer conductor arrangement 11 which is provided in this embodiment and can consist of an electrically conductive metal pipe. It also shows that formed between the metal strip-shaped leg 7' or the stub line 5 (in its parallel portion to the HF inner conductor) and the inner wall 11' of the tubular outer conductor arrangement 11 is a spacing 13 in which a dielectric 19 has been inserted. In the illustrated embodiment according to FIG. 3*a-b*, it can even be seen that the strip-shaped portion 7', running in the axial direction of the entire arrangement, of the stub line 5 is configured to be slightly convex in cross section, i.e. in its sector it comes to rest coaxially to the hollow-cylinder-shaped outer conductor arrangement in the illustrated embodiment. The impedance can be adjusted differently due to the width B of the metal strip-shaped leg 7' of the stub line 5 and the spacing 13 between the strip-shaped stub line portion and the outer conductor arrangement. In this respect, the impedance decreases when the width B increases. The impedance also decreases when the spacing 13 becomes smaller. Thus, the impedance can in turn be inversely increased even with a relatively large width B of a stub line 5 by increasing the spacing to the outer conductor pipe. The impedance can thus be adjusted in a continuously variable and differing manner. In the context of the invention, this also affords great advantages because the tolerances in respect of impedance are to be observed as accurately as possible. In the context of the invention, an easy adaptation is easily possible by changing the position of the stub line portion which runs in the axial direction. As can also be seen in the drawing, the thickness D transversely to the width B (measured transversely to the longitudinal direction of the stub line 5) can be significantly smaller than the width B. The thickness can easily be less than 50%, 40%, 30%, 20% or even less than 10% or 5% based on the width of the leg portion 7', running in the axial longitudinal direction, of the associated stub line 5. Nevertheless, the thickness can also be very much greater which, however, has no substantial influence on the electrical effect.

Figure 4A:
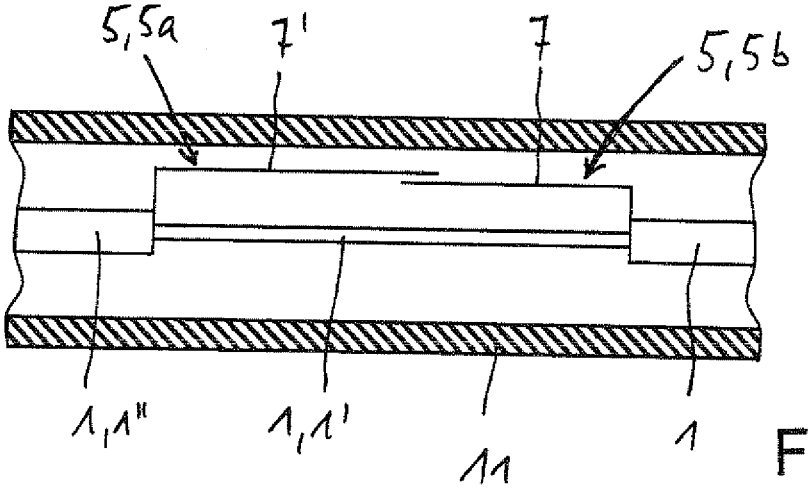
FIG. 4*a* is an axial sectional view of an embodiment modified with respect to FIGS. 1 to 1*b*, in which the free ends of two stub lines overlap, being arranged in a different radial spacing with respect to one another.
Figure 4:
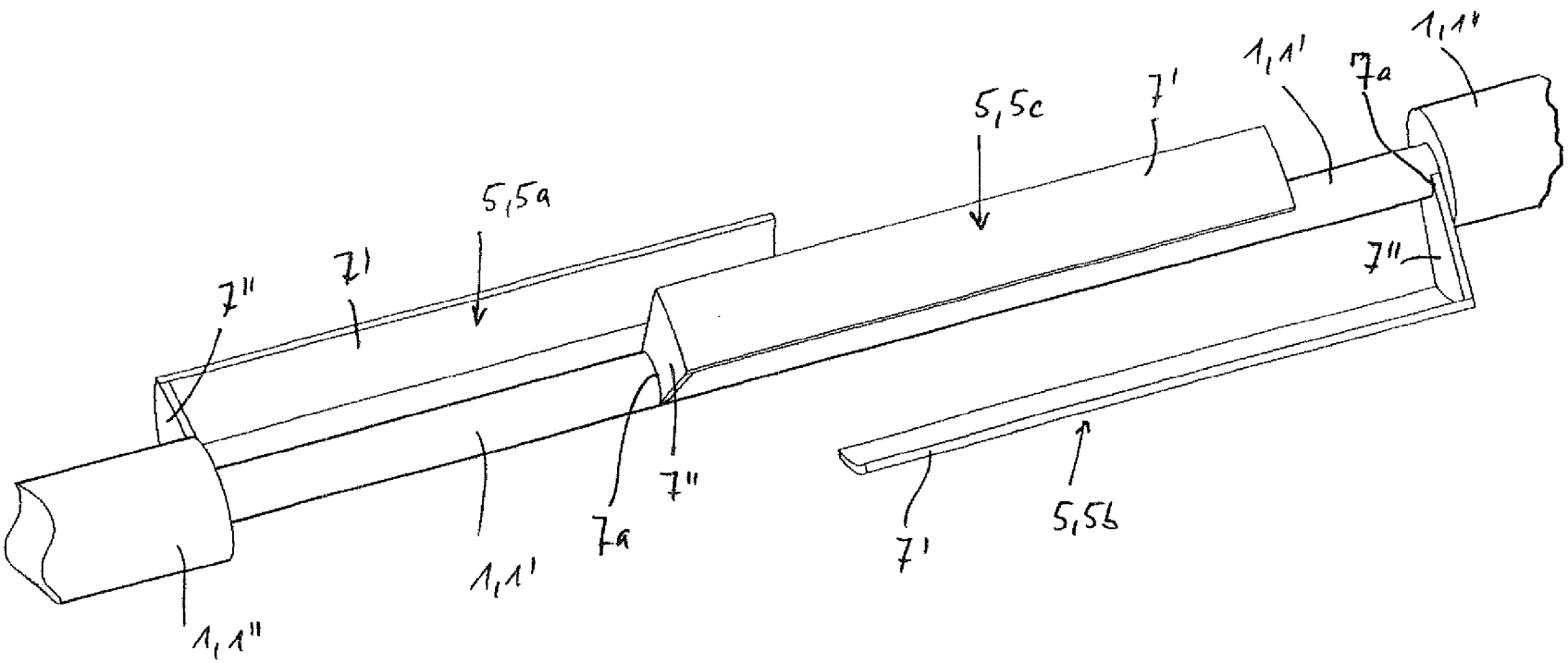
FIG. 4 is a spatial view of a modification of the preceding embodiments, omitting the outer conductor arrangement with a total of three stub lines branching off in an offset arrangement in the longitudinal direction of the HF conductor.

FIG. 4 schematically shows that a plurality of stub lines 5*a* to 5*c* which are in a respectively offset position in the peripheral direction emanate for example at connection points 7*a* which are in an offset position in the longitudinal direction of the transformation line 1', in which arrangement two stub lines 5*a*, 5*c* are not oriented such that they run in mutually opposite directions, as in the embodiment according to FIGS. 1 and 2. In this case it is possible to provide in a straightforward manner two, three or more stub lines (if appropriate also in different lengths for a different configuration of the band-stop filter).

However, differing from this, the more radially oriented legs 7" which produce the connection to the transformation line 1' can be of a different length, i.e. they can have a differing radial height to the inner conductor 1. Thus the adjoining legs 7' of the stub line 5 have a different distance from the inner conductor 1 or outer conductor 11. This also makes it possible for two or more stub lines 5 to be arranged with their freely terminating legs 7' in the same portion of path and, in this respect, they do not inevitably have to be in an offset position to the inner conductor in the peripheral direction. They can also be in a slightly offset position on the same side of the inner conductor or only in the peripheral direction, since the freely terminating leg portions 7' do not contact one another due to the differently terminating height of the first legs 7', but are offset in the radial direction with respect to the inner conductor 1, 1'. This variant with partial overlap of the strip line legs 7' is shown in FIG. 4*a*.

This arrangement in particular but also the examples according to FIG. 4, show that the freely terminating legs 7' of the stub line can be arranged to run in the same direction or in mutually opposite directions. Consequently, the stub lines, in particular the freely terminating legs 7' can partly or completely overlap one another (couple). The overlap can also be realised only partially by different angles of the legs 7', in that the freely terminating legs 7' of the individual stub lines are at least partly offset in the peripheral direction around the inner conductor 1 (i.e. consequently only a partial overlap of the freely terminating legs 7' is realised).

As also shown by FIG. 4, the stub lines 5 can also be arranged successively in the longitudinal direction of the inner conductor 1, 1', regardless of whether the freely terminating legs 7' of this stub line 5 point in the same direction or are arranged in opposite directions on the inner conductor 1.

Moving away from the embodiment according to FIGS. 1 to 4, it would also be possible for two or, for example three stub lines 5*a*, 5*b* and 5*c* which are only offset in the peripheral direction to be connected at a common connection point 7*a*, for example on the transformation line and which are of different lengths and all three of which can be oriented running with their open ends in a common direction or to some extent in different directions.

Figure 5:
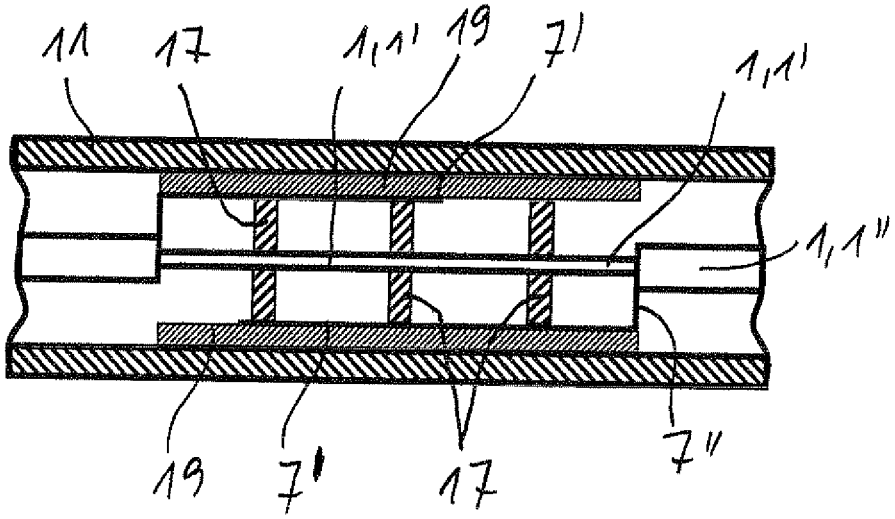
FIG. 5 is a corresponding axial sectional view, comparable with the axial sectional view according to FIG. 1, but with spacers positioned on the stub lines to restrict or observe the distance between the individual stub lines from the HF line on the one hand and from the inner wall of the outer conductor on the other hand.

From FIG. 5 (which basically corresponds to the embodiment according to the axial sectional view of FIG. 1) it can be seen that arranged, for example on the HF inner conductor 1 which forms the HF signalling line and in the longitudinal direction thereof in the region of the stub lines are one or more spacers 17 which consist of an electrically non-conductive dielectric. The outer periphery of these spacers 17 then serves as a stop surface for the axially running stub lines 5, 5*a*, 5*b* etc. which optionally rest against said surface, i.e. the leg 7'.

Likewise, but as is also shown in FIG. 5, alternatively or additionally it is possible for electrically non-conductive dielectric spacers 19 to be arranged on the stub line portions 7', as a result of which a specific distance from the outer conductor pipe 11 surrounding them can be observed. These dielectric spacers 19 can also be arranged on and/or attached to the inside of the outer conductor pipe 11 to maintain the stub line portions 7' at a predetermined distance from the outer conductor pipe 11.

Furthermore, the complete interior of large parts of the interior within the outer conductor arrangement can be filled with a dielectric, as a result of which a so-called shortening factor for the length of the stub lines 5 can be produced by changing the dielectric constant based on the dielectric used.

A trap circuit filter arrangement of this type or the arrangement of a band-stop filter of this type can be realised on any coaxial HF path.

However, the invention also has great advantages in particular when the filter is directly fitted into a socket or a socket arrangement (connector). This is shown schematically by way of example in FIG. 6.

In all the illustrated embodiments, the major advantage of the invention is that, for example, a suitable stop filter can be produced in a straightforward manner by the one or more stub lines (which are open-ended) which then merely has to be introduced into a common outer conductor arrangement which jointly surrounds the signalling line, for example in the form of a transformation line and the one or more stub lines. In spite of this arrangement, it is impossible to detect a disadvantageous, alternating interference of the function of the stub lines.

Figure 6:
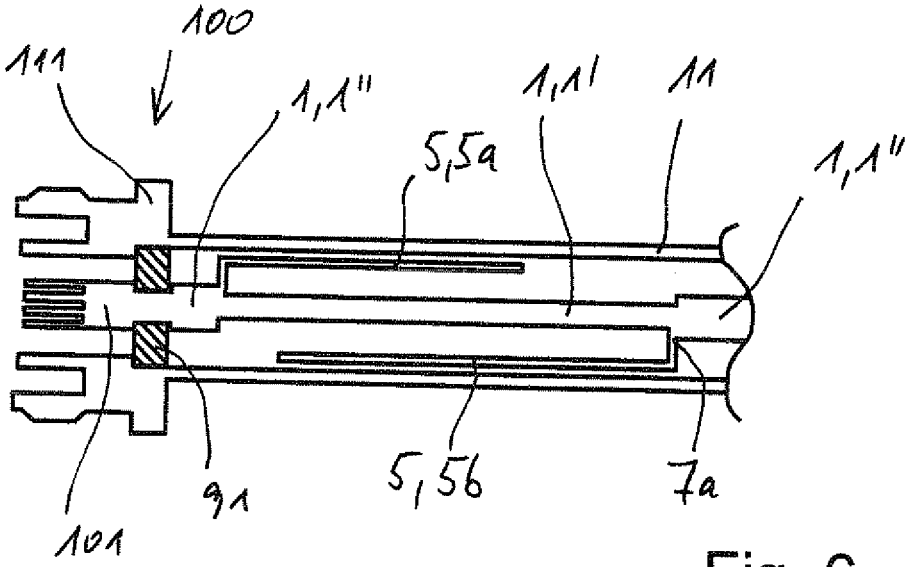
FIG. 6 is a schematic, axial sectional view of an extract from a further embodiment, in which the filter arrangement according to the invention is installed or integrated in a socket arrangement.

With reference to FIG. 6, a modification in an axial sectional view is shown insofar as the solution according to the invention is rigidly connected to a socket 100 (coaxial connector) or is configured such that they can be handled together.

FIG. 6 shows that in this case, the filter arrangement is constructed such that the tubular outer conductor 11 merges into the socket outer conductor 111 and the HF inner conductor 1 merges into the socket inner conductor 101. In the illustrated embodiment, the socket inner conductor 101 is not plug-shaped (which would also be possible), but is socket-shaped and has on its insertion end a plurality of contact fingers which are separated from one another by longitudinal slots in the peripheral direction.

In this case, the socket inner conductor 101 is held at a distance from the outer conductor 111 by an insulator (dielectric) 91 in a known manner, avoiding galvanic contact.

On the opposite side, the inner conductor and the outer conductor can directly merge into a cable connection, which is not shown in more detail. However, it is also possible to provide a suitable contact plug or a suitable contact socket (coaxial connector) on the opposite side.

In the illustrated embodiment, a standard socket can be used, for example, to standard DIN 7-16 (IEC 60 169-4). However, the basic construction can also be realised for all other socket or plug arrangements with socket-shaped or plug-shaped inner conductors or socket-shaped or plug-shaped outer conductors.

Figure 7:
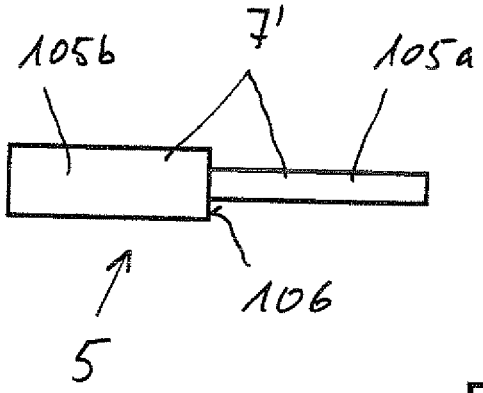
FIG. 7 is a schematic side view of a stub line which, in the illustrated embodiment, is configured in the longitudinal direction of the stub line with at least one graduated shoulder with the formation of two strip line portions of a different width.

Finally, reference will also be made to the embodiment according to FIG. 7 in which a stub line 5 is shown in a schematic plan view. This can be, for example the transverse view of the stub lines which are shown positioned below in FIG. 6.

It can be seen that the stub line 5, for example starting from its connection point 7*a*, has a first stub line portion 105*a* which then merges, via a subsequent step 106, into a portion 105*b* which is wider than said first stub line portion 105*a*. In other words, the width B of the stub line 5 towards the free end is greater than in the first stub line portion 105*a* which is closer to the connection point 7' to the HF inner conductor 1 or to the transformation line 1'.

If required, more gradations 106 of this type can also be provided, i.e. not only one gradation with two stub line portions 105*a*, 105*b* in different widths, but for example with three stub line portion of different widths, or even more.

Therefore, the stub lines can be configured in multiple stages, i.e. with different widths (in which case the widening in the width direction is preferably provided symmetrically on both sides with respect to the longitudinal direction of the inner conductor). In addition, the diameters and the thicknesses can also differ. A construction of this type makes it possible to realise, overall, a very wide-band filter arrangement which has advantages in many frequency ranges, in particular in many frequency ranges as used in mobile telecommunications, for example in the range of from 694 MHz to 960 MHz or for example also in the range of from 1710 MHz to 2700 MHz. There are, however, no restrictions to specific frequency ranges.

Figure 8:
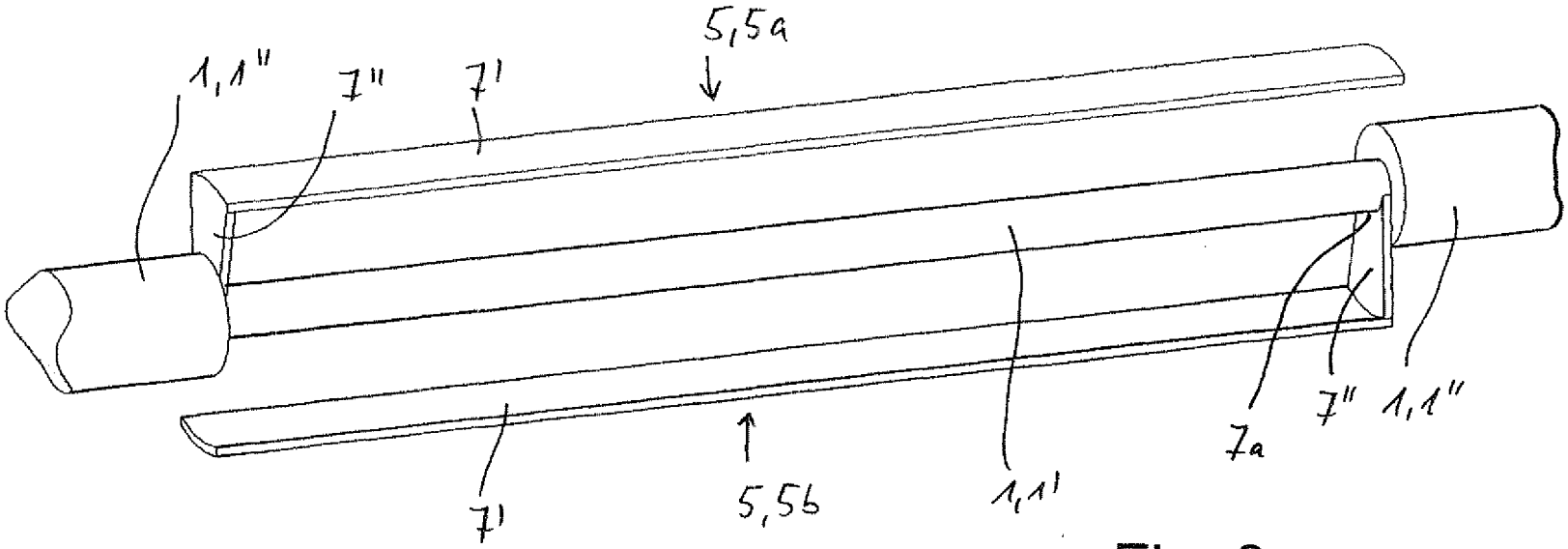
FIG. 8 shows an embodiment, modified with respect to FIG. 2, having stub lines of an equal length.

Finally, FIG. 8, unlike FIG. 2, shows that in principle, the individual stub lines, in particular when two or more stub lines are provided can of course also be of the same length, in which case the effective length parallel to the transformation line 1' can correspond in terms of length to the portion of the respective stub lines which runs parallel to said transformation line 1'.

The invention claimed is:

1. A filter arrangement comprising:

a first HF-inner conductor, a second HF-inner conductor spaced apart from the first HF inner conductor in a longitudinal direction, a transformation line extending between the first and second HF-inner conductors, a tubular outer conductor arrangement having a round or square cross-section in which the HF-inner conductors with the transformation line are arranged coaxially, at least first and second stub lines which are both connected electrically/galvanically with and held mechanically at a connection point at the transformation line;

the at least first and second stub lines configured in the form of electrically conductive metal strips whereby each of the metal strips is provided with a longitudinal extension, a width and a thickness whereby the width in the transverse direction transverse to the longitudinal direction of the metal strips is bigger than the thickness of the metal strips;

the transformation line as well as the at least first and second stub lines are arranged in the tubular outer conductor arrangement; and at least one of the at least first and second stub lines which branches off from the transformation line is configured as one of said metal strips comprising a leg portion which is more than 60% of the total length of the respective stub line whereby this leg portion runs parallel to the first HF-inner conductor or in an angle (a) of less than 10° with respect to the first HF-inner conductor, wherein the first stub line has an electrical length such that the frequency response of the first stub line would be overcompensated by the adjoining transformation line, the adjoining second stub line compensating the overcompensated frequency response caused by the transformation line to provide an overall desired frequency response.

2. The filter arrangement according to claim 1, wherein the first stub line extends at a distance from the first HF inner conductor and is mechanically and electrically connected to the first HF inner conductor at the connection point by a connecting angle.

3. The filter arrangement of claim 1 wherein the first HF inner conductor forms the transformation line provided between the first and second HF inner conductors spaced apart to each other.

4. The filter arrangement of claim 1 wherein the outer conductor arrangement has a section which is round or square in cross-section to avoid that the E-field lines starting from the at least first and second stub lines end at another portion of the outer conductor arrangement than the E-field lines starting from the transformation line.

5. The filter arrangement according to claim 1, wherein the leg portion is arranged parallel to an inner wall of the outer conductor arrangement.

6. The filter arrangement according to claim 5, wherein the impedance of the filter arrangement is configured to be adjusted and/or preselected differently by changing the spacing between the first stub line and the inner wall of the outer conductor arrangement and/or by changing the width of the first stub line.

7. The filter arrangement according to claim 1, wherein the leg portion includes over its length regions with a differing distance from the first HF inner conductor.

8. The filter arrangement according to claim 1, wherein positioned on the first HF inner conductor and/or on the first stub line is a dielectric spacer which delimits or fixes the distance between the leg portion, running substantially parallel to the first HF inner conductor, of the first stub line and the first HF inner conductor.

9. The filter arrangement according to claim 1, wherein provided or positioned on the leg of the first stub line and/or on the inner wall of the outer conductor arrangement is a dielectric spacer which delimits or fixes the distance between the leg portion of the first stub line and the inner wall of the outer conductor arrangement.

10. The filter arrangement according to claim 1, wherein the length of the first stub line is adapted to achieve a frequency-dependent stop effect.

11. The filter arrangement according to claim 1, wherein space inside the outer conductor arrangement, while receiving the first HF inner conductor and the first stub line, is partly or completely filled with a dielectric.

12. The filter arrangement according to claim 1, wherein the filter arrangement is fitted into a socket.

13. The filter arrangement according to claim 1, wherein the at least first and second stub lines are arranged offset with respect to one another in the peripheral direction such that the at least first and second stub lines overlap at least in a partial length of the transformation line.

14. The filter arrangement according to claim 1, wherein the at least first and second stub lines are held mechanically and electrically at the same height of the first HF inner conductor at the common connection point and/or mutually offset in the longitudinal direction of the first HF inner conductor.

15. The filter arrangement according to claim 1, wherein the at least first and second stub lines are oriented running with free ends thereof in the same axial direction or in opposite directions to one another.

16. The filter arrangement according to claim 1, wherein the at least first and second stub lines are of different lengths to achieve a different number of stop poles and thus a different band width of a stop effect.

17. The filter arrangement according to claim 1, wherein the first stub line is configured in multiple stages over its length and comprises at least two portions, comprising a stub line portion and a further stub line portion which differ in width.

18. The filter arrangement according to claim 17, wherein the stub line portion and the further stub line portion of different widths become wider from the connection point in the direction towards a free end of the first stub line.

19. The filter arrangement according to claim 1, wherein the first stub line and at least a freely terminating portion of the first stub line is configured to be curved in cross section transversely to the longitudinal extent with a convex curvature with respect to the outer conductor arrangement, smaller than semi-cylindrical, so that the first and second stub lines are offset by 180° with respect to the first HF inner conductor and are arranged coaxially to the first HF inner conductor.

20. The filter arrangement according to claim 1, wherein the leg portion emanates from the connection point and is configured with a different height with respect to the first inner conductor and/or terminates at a different radial distance from the first HF inner conductor, such that adjoining freely terminating portions of the first stub line are in a partially overlapping arrangement.

21. The filter arrangement according to claim 20, wherein freely terminating portions of the at least first and second stub lines are at least in a partially mutually overlapping arrangement.

22. The filter arrangement according to claim 1, wherein the at least first and second stub lines are in a mutually offset arrangement at least in their partial length in the same path portion of the first HF inner conductor in the axial direction of the first HF inner conductor.

23. The filter arrangement according to claim 1, wherein the filter is arranged in a coaxial line.

* * * * *